US008922362B2

(12) United States Patent
Johnson et al.

(10) Patent No.: US 8,922,362 B2
(45) Date of Patent: Dec. 30, 2014

(54) TEMPORAL HORN PATTERN SYNCHRONIZATION

(75) Inventors: Erik Johnson, Philadelphia, PA (US); John M. Yerger, Harleysville, PA (US)

(73) Assignee: Microchip Technology Incorporated, Chandler, AZ (US)

( * ) Notice: Subject to any disclaimer, the term of this patent is extended or adjusted under 35 U.S.C. 154(b) by 402 days.

(21) Appl. No.: 13/478,486

(22) Filed: May 23, 2012

(65) Prior Publication Data

US 2013/0120136 A1 May 16, 2013

Related U.S. Application Data

(60) Provisional application No. 61/558,526, filed on Nov. 11, 2011.

(51) Int. Cl.

| | |
|---|---|
| ***G08B 23/00*** | (2006.01) |
| ***G08B 7/06*** | (2006.01) |
| ***G08B 3/10*** | (2006.01) |

(52) U.S. Cl.

CPC ... *G08B 3/10* (2013.01); *G08B 7/06* (2013.01)
USPC ..... 340/517; 340/506; 370/445

(58) Field of Classification Search

USPC ..... 370/445, 335; 711/167; 712/234; 713/400; 84/603; 710/100; 327/141; 340/506, 517, 521

See application file for complete search history.

(56) References Cited

U.S. PATENT DOCUMENTS

| | | | | |
|---|---|---|---|---|
| 2002/0101344 | A1 | 8/2002 | Tanguay | 340/508 |
| 2005/0200472 | A1 | 9/2005 | Curran et al. | 340/506 |
| 2009/0128353 | A1 | 5/2009 | Gonzales | 340/691.5 |
| 2009/0201143 | A1 * | 8/2009 | McKenna et al. | 340/506 |
| 2011/0019748 | A1 | 1/2011 | Burns et al. | 375/242 |

FOREIGN PATENT DOCUMENTS

| | | | | |
|---|---|---|---|---|
| EP | 1426908 | A2 | 6/2004 | G08B 17/10 |
| EP | 2228777 | A1 | 9/2010 | G08B 17/00 |
| WO | 2009/101404 | A1 | 8/2009 | G08B 26/00 |

OTHER PUBLICATIONS

International Search Report and Written Opinion, Application No. PCT/US2012/064339, 13 pages, May 3, 2013.
International Search Report and Written Opinion, Application No. PCT/US2012/064105, 9 pages, Mar. 25, 2013.

* cited by examiner

*Primary Examiner* — Steven Lim
*Assistant Examiner* — Kaleria Knox
(74) *Attorney, Agent, or Firm* — King & Spalding L.L.P.

(57) ABSTRACT

A plurality of hazard alarm devices are in spatially diverse locations and coupled together with an input-output bus. An interconnect protocol enables non-originating alarm devices to synchronize their audible alert tone pulses with audible alert tone pulses from an originating alarm device in a local hazard alarm condition. Hence, all audible alert tone pulses start sounding substantially together with allowances for signal contention and arbitration between the spatially diverse alarm devices.

20 Claims, 8 Drawing Sheets

TEMPORAL HORN PATTERN SYNCHRONIZATION

RELATED PATENT APPLICATIONS

This application claims priority to commonly owned U.S. Provisional Patent Application Ser. No. 61/558,526; filed Nov. 11, 2011; entitled "Temporal Horn Pattern Synchronization," by Erik Johnson and John M. Yerger; and is related to commonly owned co-pending U.S. patent application Ser. No. 13/665,459; filed, Oct. 31, 2012; entitled "Automatic Audible Alarm Origination Locate," by Erik Johnson; both of which are hereby incorporated by reference herein for all purposes.

TECHNICAL FIELD

The present disclosure relates to hazard detection and alarm signaling devices, and, more particularly, to temporal horn pattern synchronization of the alarm signaling portion of the devices.

BACKGROUND

Hazard detection and alarm signaling devices for detecting fire, smoke, carbon monoxide, radon, natural gas, chlorine, water, moisture, etc., are well known in the art. Such devices may be coupled together to form an interconnected system of, for example, independent spatially diverse smoke detectors using an input-output (IO) bus. However, conventional devices using IO buses are not dynamic and can therefore not accommodate synchronization or accommodate alarm signaling contentions.

A temporal horn pattern has become a standard evacuation pattern in the smoke detection market. The pattern is 0.5 seconds on and 0.5 seconds off for three pulses (cycles) then 1.5 seconds off before starting a new sequence of three pulses, e.g., per the National Fire Protection Association (NFPA) 72: National Fire Alarm and Signaling Code. Commercial and industrial hazard detection and alarm annunciation systems use complex and expensive central panel monitoring and alarm annunciation control for synchronization of the temporal horn patterns. In a residential spatially diverse multiple detector system there is currently no integrated circuit based device that will synchronize the temporal horn pattern. Without synchronization, the clarity of the temporal horn pattern may be lost, see FIG. 2.

SUMMARY

Therefore, a need exists to have interconnected spatially diverse multiple devices of a hazard detection and alarm signaling system, wherein an initiating device in alarm can cycle the other interconnected devices whether they are in an alarm condition or not, such that the resulting temporal horn patterns therefrom are synchronized to the initiating device's horn pattern.

According to an embodiment, a method for temporal horn pattern synchronization may comprise the steps of: monitoring an input-output bus coupling together a spatially diverse plurality of hazard detection and alarm devices; detecting when the input-output bus at a first logic level goes to a second logic level; determining if the second logic level remains on the input-output bus for a first time period, wherein if so, then determining which ones of the plurality of hazard detection and alarm devices are in a local alarm condition and which other ones are not in the local alarm condition, wherein the ones that are in the local alarm condition are designated as follower devices and the other ones that are not in the local alarm condition are designated as slave devices, and if not, then determining when one of the plurality of hazard detection and alarm devices is in the local alarm condition; making a first one of the plurality of hazard detection and alarm devices in the local alarm condition a master device; asserting the second logic level on the input-output bus with the master device; asserting the first logic level on the input-output bus with the master device for short times between asserting the second logic level thereon; and synchronizing groups of alert tone pulses from the master, follower and slave devices.

According to a further embodiment of the method, the steps may further comprise: waiting a second time period after determining that the second logic level has remained on the input-output bus for the first time period; and activating a synchronized group of alert tone pulses from the follower and slave devices. According to a further embodiment of the method, the steps may further comprise: waiting a third time period after asserting the second logic level on the input-output bus with the master device; and activating a synchronized group of alert tone pulses from the master device, wherein the third time period is equal to the sum of the first and second time periods. According to a further embodiment of the method, the steps may further comprise: determining whether the input-output bus remains at the first logic level for a certain time during a contention time window, wherein if so, then making a one of the follower devices a new master device and having the new master device assert the second logic level on the input-output bus; and if not, then retaining prior status for each of the master, follower and slave devices.

According to a further embodiment of the method, the first logic level is a low logic level and the second logic level is a high logic level. According to a further embodiment of the method, the first logic level is a high logic level and the second logic level is a low logic level. According to a further embodiment of the method, the first and second logic levels are different voltage values on the input-output bus. According to a further embodiment of the method, the first and second logic levels are different current values into the input-output bus. According to a further embodiment of the method, each group of the alert tone pulses are three tone pulses within about four seconds. According to a further embodiment of the method, the plurality of hazard detection and alarm devices are capable of detecting hazards selected from the group consisting of fire, smoke, carbon monoxide, radon, natural gas, chlorine, water and moisture.

According to another embodiment, a hazard detection and alarm system may comprise: a plurality of hazard detection and alarm devices coupled together with an input-output bus, where the plurality of hazard detection and alarm devices are spatially diverse; one of the plurality of hazard detection and alarm devices becomes a master when in a local alarm, other ones of the plurality of hazard detection and alarm devices become followers when in a local alarm occurring after the occurrence of the master local alarm, and still other ones of the plurality of hazard detection and alarm devices become slaves when not in a local alarm; and the master asserts a second logic level on the input-output bus that was previously at a first logic level, then periodically asserts the first logic level on the input-output bus for a first time period, then thereafter asserts no logic level on the input-output bus for a second time period and thereafter reasserts the second logic level on the input-output bus, wherein all followers and slaves synchronize their alert tone pulse groups to alert tone groups of the master from when the input-output bus goes from the first logic level to the second logic level and remains at the second logic level for a first time period.

According to a further embodiment, when one of the followers in local alarm detects that the input-output bus is at the first logic level for a certain time, that follower becomes the master and thereafter asserts the second logic level on the input-output bus. According to a further embodiment, the master may further comprise asserting no logic level between the assertion of the first logic level and second logic level, wherein if the master detects that the input-output bus is at the second logic level when not asserting the first or the second logic levels on the input-output bus, the master becomes a follower. According to a further embodiment, the plurality of hazard detection and alarm devices have at least one sensor capable of detecting at least one hazard selected from any one or more of the group consisting of fire, smoke, carbon monoxide, radon, natural gas, chlorine, water and moisture.

According to a further embodiment, each of the plurality of hazard detection and alarm devices may comprise: a hazard detector; an alarm alert generator; an audible sound reproducer coupled to an output of the alarm alert generator; a digital processor having a first input coupled to the hazard detector for receiving a hazard detection signal and a first output coupled to the alarm alert generator for control thereof; a bus driver having an input coupled to a second output of the digital processor and an output coupled to the input-output bus; a bus receiver having an input coupled to the input-output bus and an output coupled to a second input of the digital processor; and a time delay filter having an input coupled to the output of the bus receiver and an output coupled to a third input of the digital processor. According to a further embodiment, the digital processor determines a master, follower or slave state of the hazard detection and alarm device. According to a further embodiment, the digital processor is a microcontroller.

According to still another embodiment, a hazard detection and alarm device may comprise: a hazard detector; an alarm alert generator; an audible sound reproducer coupled to an output of the alarm alert generator; a digital processor having a first input coupled to the hazard detector for receiving a hazard detection signal and a first output coupled to the alarm alert generator for control thereof; a bus driver having an input coupled to a second output of the digital processor and an output adapted for coupling to an input-output bus; a bus receiver having an input adapted for coupling to the input-output bus and an output coupled to a second input of the digital processor; and a time delay filter having an input coupled to the output of the bus receiver and an output coupled to a third input of the digital processor; wherein the digital processor determines a master, follower or slave state of the hazard detection and alarm device.

According to further embodiment, the alarm alert generator may comprise: an audio tone generator; an audio tone pulse synchronization circuit having an input coupled to the audio tone generator; and an audio power amplifier having an input coupled to an output from the audio tone pulse synchronization circuit and an output coupled to the audible sound reproducer. According to further embodiment, the bus driver has a low impedance first output state, a low impedance second output state, and a high impedance output state, wherein selection of the output states are controlled by the digital processor.

BRIEF DESCRIPTION OF THE DRAWINGS

A more complete understanding of the present disclosure may be acquired by referring to the following description taken in conjunction with the accompanying drawings wherein.

Figure 1:
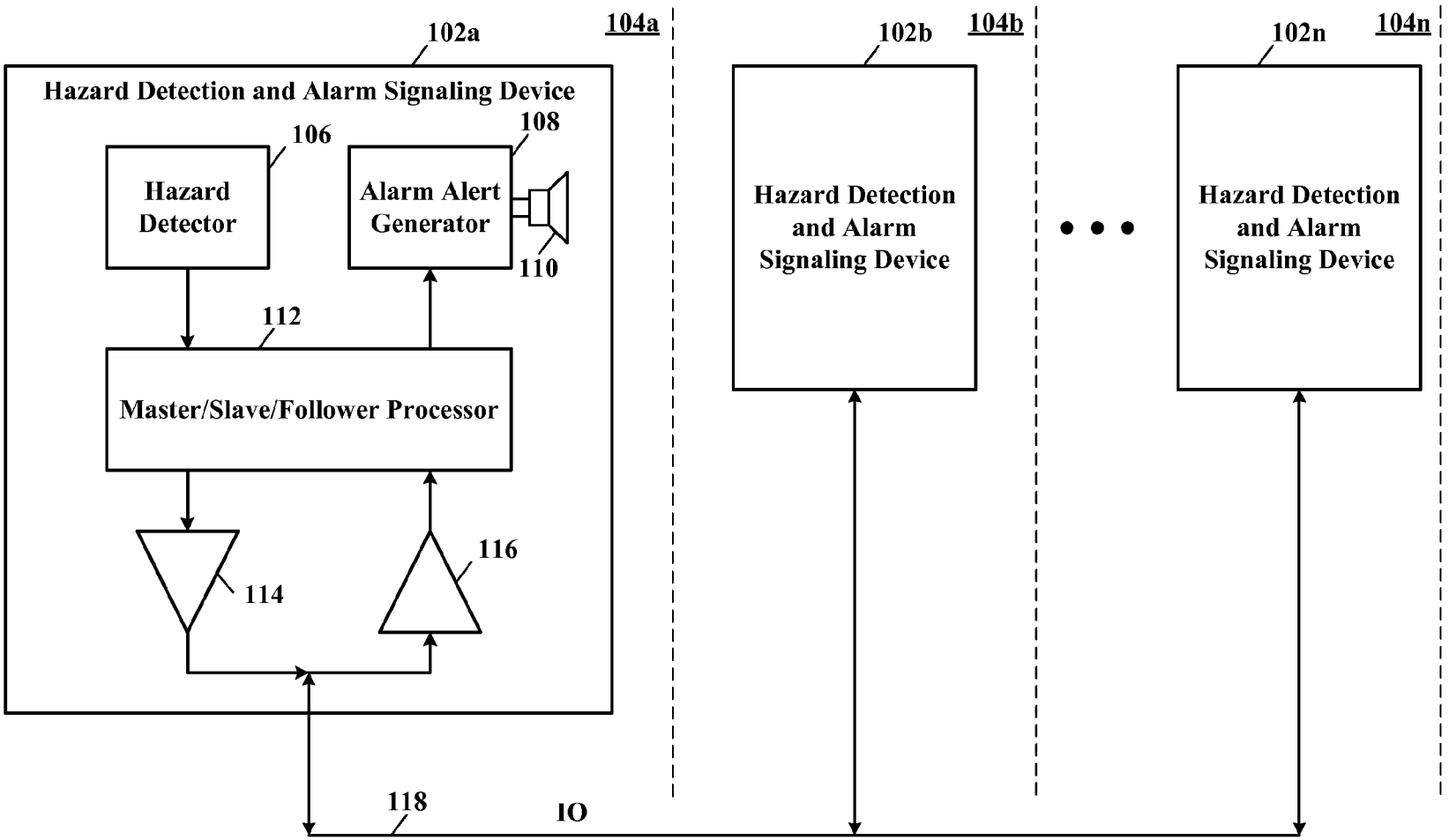
FIG. 1 illustrates a schematic block diagram of a hazard detection and alarm signaling system having a plurality of hazard detection and alarm signaling devices coupled together with an input-output (IO) bus, according to a specific example embodiment of this disclosure.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

A plurality of hazard alarm devices are in spatially diverse locations and coupled together with an input-output bus. An interconnect protocol enables non-originating alarm devices to synchronize their audible alert tone pulses with audible alert tone pulses from an originating alarm device in a local hazard alarm condition. Hence, all audible alert tone pulses start sounding substantially together with allowances for signal contention and arbitration between the spatially diverse alarm devices.

Referring now to the drawings, the details of specific example embodiments are schematically illustrated. Like elements in the drawings will be represented by like numbers, and similar elements will be represented by like numbers with a different lower case letter suffix.

Referring to FIG. 1, depicted is a schematic block diagram of a hazard detection and alarm signaling system having a plurality of hazard detection and alarm signaling devices coupled together with an input-output (IO) bus, according to a specific example embodiment of this disclosure. A plurality of hazard detection and alarm signaling devices 102 are located in spatially diverse locations (e.g., rooms) 104, and coupled together with an IO bus 118. Each of the plurality of hazard detection and alarm signaling devices 102 may comprise a hazard detector 106, an alarm alert generator 108, an audible sound reproducer 110, master/slave/follower processor 112, an IO bus driver 114 and an IO bus receiver 116. The hazard detector 106 may detect, for example but is not limited to, smoke, carbon monoxide, radon, gas, chlorine, moisture, etc. The audible sound reproducer 110 may be, for example but is not limited to, a speaker, a piezo-electric transducer, a buzzer, a bell, etc. The master/slave/follower processor 112 may comprise, but is not limited to, a microcontroller and program memory, a microcomputer and program memory, an application specific integrated circuit (ASIC), a programmable logic array (PLA), etc.

The interconnection of the plurality of hazard detection and alarm signaling devices 102 with the IO bus 118 may be accomplished by conventional means well know to those skilled in the art of electronics and use industry standard drivers, receivers and bus loading techniques. However since the interconnect protocol described herein is new, novel and non-obvious, other newer and more sophisticated means of interconnection may also be applied with equal or better effectiveness. It is contemplated and within the scope of this disclosure that the IO bus 118 may also be implemented as a wireless data network, e.g., Bluetooth, Zigbee, WiFi, WLAN, AC line carrier current, etc.

Figure 2:
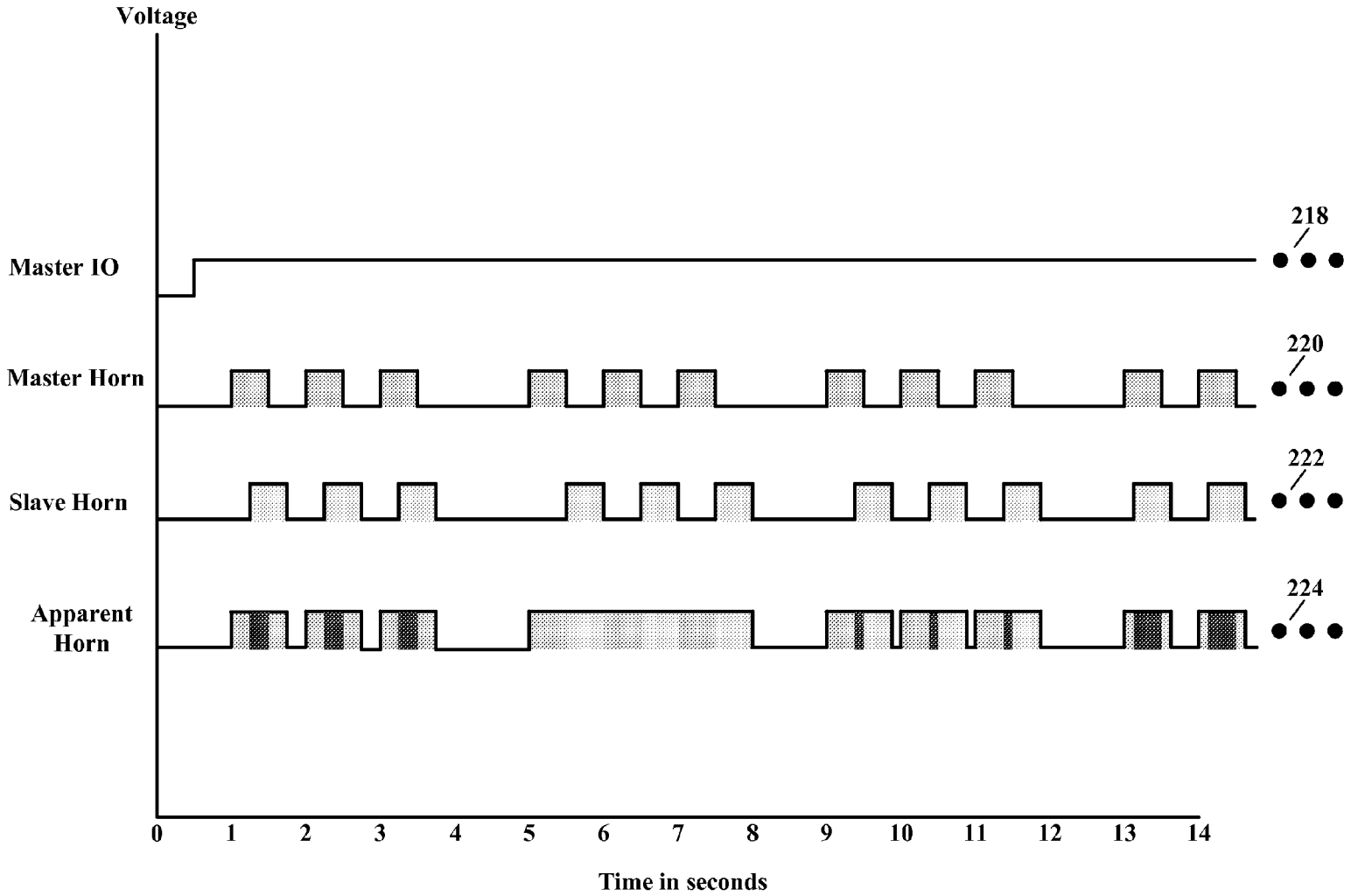
FIG. 2 illustrates schematic timing diagrams of temporal audible alarm signals that are not synchronized together.

Referring to FIG. 2, depicted are schematic timing diagrams of temporal audible alarm signals that are not synchronized together. A master device 102 goes into an alarm condition and drives the IO bus 118 high with a master IO signal 218. The master device 102 emits audible alert tone pulses 220 at defined time intervals, for example but not limited to, groups of three alert tone pulses at four (4) second cycles per the National Fire Protection Association (NFPA) 72: National Fire Alarm and Signaling Code. At least one of the other devices 102, not necessarily in alarm, repeats the three alert tone pulses 222. However there is not way to synchronize the tone pulses 220 from the master device 102 in alarm and the tone pulses 222 from the at least one of the other devices 102. Resulting apparent tone pulses 224 are shown having examples of various off synchronization phasing resulting in a jumble of confusing tones that do not clearly annunciate an alarm condition.

Figure 3:
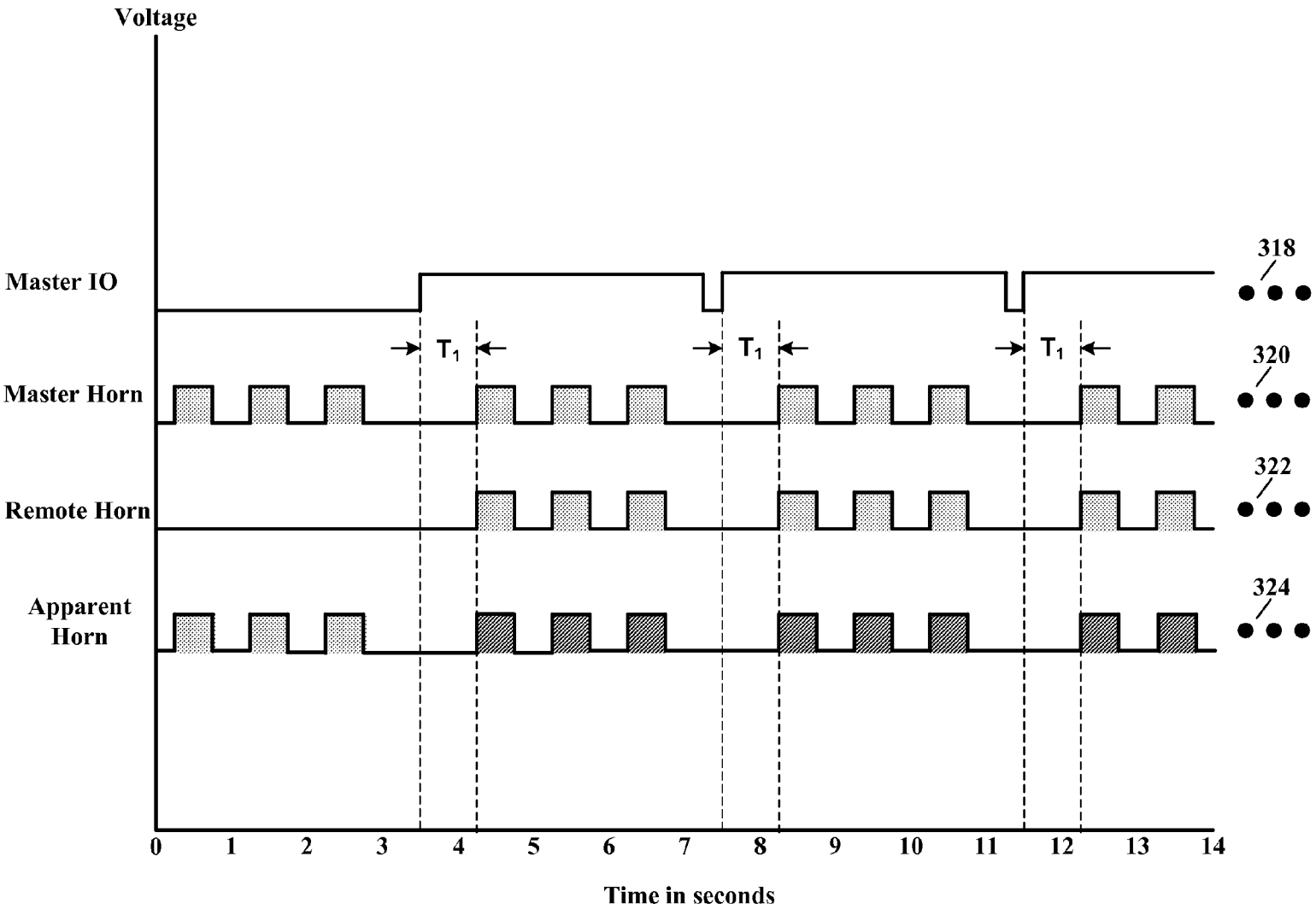
FIG. 3 illustrates schematic timing diagrams of temporal audible alarm signals that are synchronized together, according to a specific example embodiment of this disclosure.

Referring to FIG. 3, depicted are schematic timing diagrams of temporal audible alarm signals that are synchronized together, according to a specific example embodiment of this disclosure. A master device 102 goes into an alarm condition and drives the IO bus 118 high with a master IO signal 318 starting at time $T_0$, and periodically goes low to provide a synchronization signal to all other devices 102 connected to the IO bus 118, as more fully described hereinafter. The master device 102 may emit audible alert tone pulses 320 at defined time intervals, for example but not limited to, groups of three alert tone pulses at four (4) second cycles per the National Fire Protection Association (NFPA) 72: National Fire Alarm and Signaling Code. Optionally, the start of a group of three tone pulses 320 may occur after a time, $T_1$, from a positive going edge of the master IO signal 318, and thereafter be synchronized thereto. At least one of the other devices 102, not necessarily in alarm, may repeat with the three alert tone pulses 322 in synchronization with the positive going edges of the master IO signal 318. The resulting apparent tone pulses 324 are audibly reinforced from the synchronized tone pulses 320 and 322, thereby clearly annunciating an alarm condition. The remote devices 102 may synchronize to the rising edge of the master IO signal 318 with a delay of time $T_1$ before starting the remote horn alert tone pulses 322. The originating device 102 anticipates a delay for the master IO signal 318 such that timing for the originating (master) and remote alarm alert tone pulses 320 and 322 are substantially the same.

Figure 4:
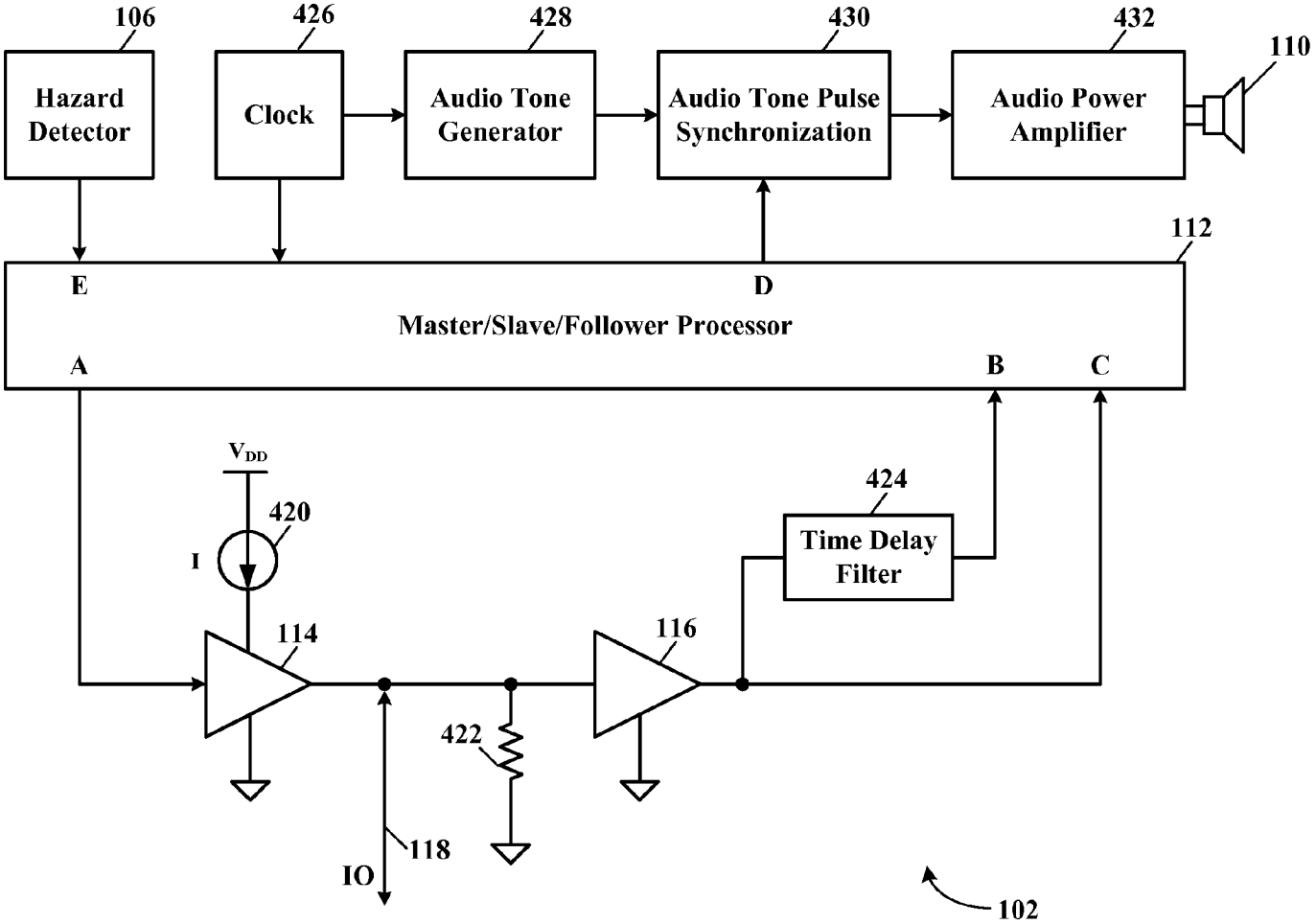
FIG. 4 illustrates a schematic block diagram of a hazard detection and alarm signaling device shown in FIG. 1, according to a specific example embodiment of this disclosure.

Referring to FIG. 4, depicted is a schematic block diagram of a hazard detection and alarm signaling device shown in FIG. 1, according to a specific example embodiment of this disclosure. The hazard detection and alarm signaling device 102 is as described in FIG. 1 hereinabove, wherein the IO bus driver 114 may have a constant current output determined by the constant current source 420, and is tri-stated such that its output may be placed in a high impedance state. A bus load resistor 422 acts as a soft pull-down when the IO bus driver 114 is in the high impedance output state. An output from the IO bus receiver 116 is coupled to a first input of the master/slave/follower processor 112 and a time delayed output from a time delay filter 424 is coupled to a second input of the master/slave/follower processor 112. The time delay filter 424 may be configured for, but is not limited to, a delay of 320 milliseconds plus or minus three (3) percent wherein pulses of 300 milliseconds or less are ignored, e.g., no output from the time delay filter 424. These two signals (outputs to B and C) may be used in combination to insure that false triggering of the plurality of hazard detection and alarm signaling devices 102 do not occur.

The hazard detector 106 is coupled to an input of the master/slave/follower processor 112 and provides an output signal when a hazard is detected. The alarm alert generator 108 shown in FIG. 1 may comprise a clock 426, audio tone generator 428, an audio tone pulse synchronization circuit 430 and an audio power amplifier 432 for driving the audible sound reproducer 110. Other combinations of circuit functions can be used for the alarm alert generator 108 as would be known to one having ordinary skill in electronic design and the benefit of this disclosure.

The audio tone pulse synchronization circuit 430 may be controlled by the master/slave/follower processor 112, or may be part of it, to provide audible alert tone pulses 320 if a master device 102 detects an alarm condition, or to provide synchronized tone pulses 322, if a slave or follower device 102, based upon the rising positive edges of the master IO signal 318 (see FIG. 3). The time delay filter 424 may be separate from or part of the master/slave/follower processor 112, and may be accomplished in hardware and/or software as would be known to one having ordinary skill in digital microcontroller design and having the benefit of this disclosure.

The following definitions will be used hereinafter in describing the functional operation of the hazard detection and alarm signaling devices 102.

- Master—hazard detection device in local hazard alarm driving the IO bus 118, only one hazard detection device can be Master at a time.
- Slaves/Remotes—hazard detection devices not in local hazard alarm, sounding alarm only in response to assertion of a Master IO signal 518 on the IO bus 118.
- Followers—hazard detection devices in local hazard alarm not driving the IO bus 118 but sounding alarm in response to assertion of a Master IO signal 518 on the IO bus 118.
- Contention Window—time when the Master does not drive the IO bus 118 (high or low), so that a Follower can take over the IO bus 118 as a Master when there is no other hazard detection device driving the bus 118 for a certain length of time.

Figure 5:
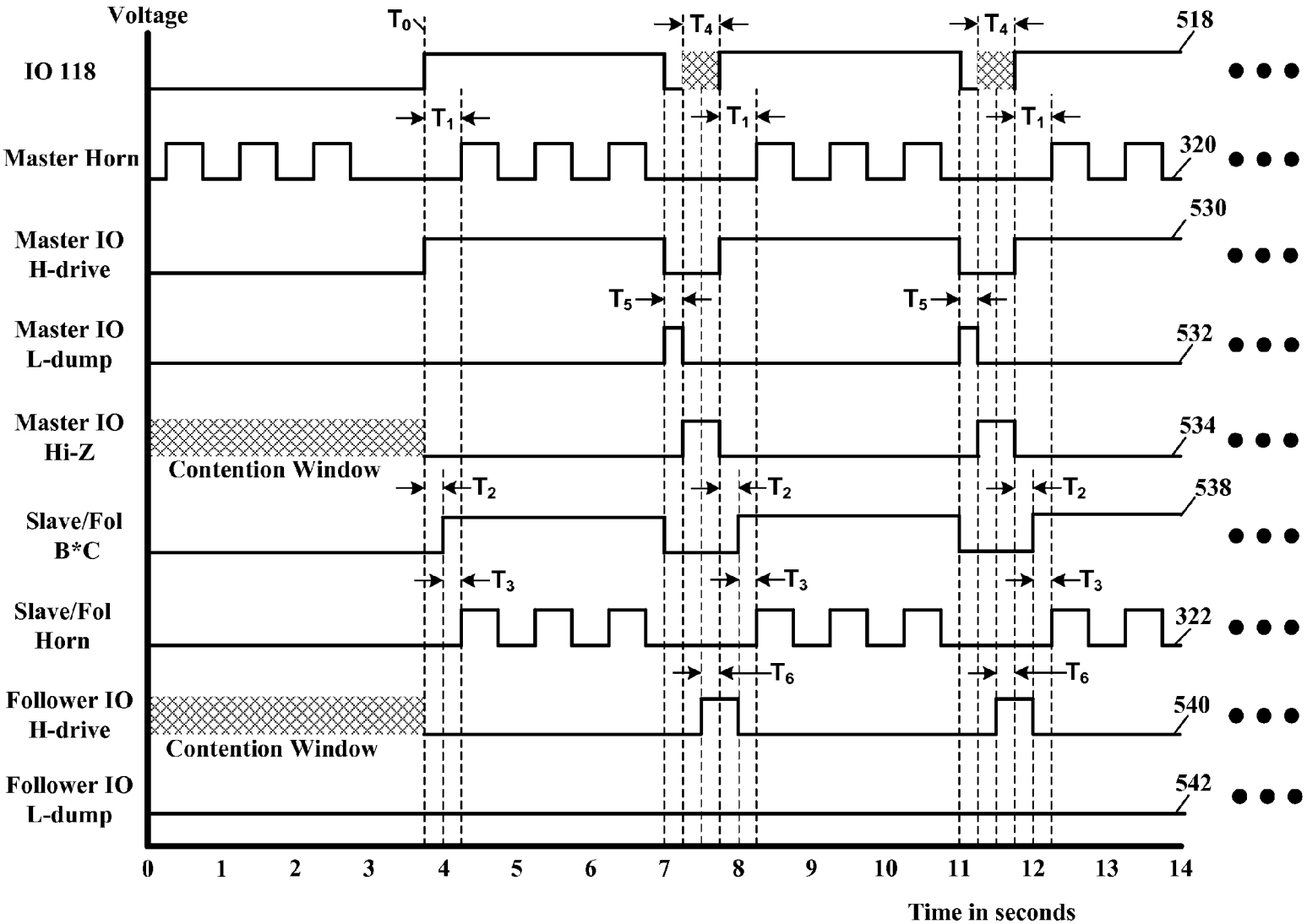
FIG. 5 illustrates schematic timing diagrams of temporal audible alarm and control signals of the hazard detection and alarm signaling devices shown in FIGS. 1 and 4, according to a specific example embodiment of this disclosure.

Referring to FIG. 5, depicted are schematic timing diagrams of temporal audible alarm and control signals of the hazard detection and alarm signaling devices shown in FIGS. 1 and 4, according to a specific example embodiment of this disclosure. When a hazard detection and alarm signaling device 102 is first to go into a local alarm, e.g., local hazard detected by the hazard detector 106 of that device 102, it becomes the "master" device 102. Wherein audible alert tone pulses 320 begin issuing therefrom. After the first set of three pulses 320, the master device 102 asserts a signal 518 at a logic high, e.g., a voltage or current, positive or negative with reference to a zero voltage or current when no other master IO signal 518 has previously been asserted for a certain length of time, e.g., seven (7) seconds. A first assertion of the master IO signal 518 occurs at time $T_0$ which is after the first set of audible alert tone pulses 320, and continues asserted until after the end of the next set of three audible alert tone pulses 320.

The start of the next set of three audible alert tone pulses 320 occurs after time $T_1$ has elapsed. For time $T_5$ the master IO signal 518 is asserted at a logic low on the IO bus 118. The logic low thereon discharges any residual voltage or current on the IO bus 118 from the logic high previously thereon. A master IO high-drive is shown as signal 530 corresponds to logic highs asserted on the IO bus 118 by the master IO signal 518, and a master IO low dump is shown as signal 532 and corresponds to logic lows asserted on the IO bus 118 by the master IO signal 518 for residual voltage discharge therefrom. There is no active assertion of the master IO signal 518 on the IO bus 118, either at a logic high or low level, during a time period $T_4$. During the time period $T_4$ a master IO high impedance signal 534 is at a logic high which indicates that the IO bus 118 is in a "high impedance" state so that a Follower device 102 in alarm may become a Master if the present Master device 102 is no longer in an alarm condition.

The master IO high impedance signal 540 represents when contention windows for the IO bus driver 114 of the present Master device 102 briefly goes into an off or high impedance output state for time $T_4$. During time $T_4$ another Follower device 102 in alarm can attempt to "grab" the IO bus 118 and become a Master device 102, but only when there is no logic high asserted on the IO bus 118 for a certain time period, e.g., about seven (7) seconds. The Follower device 102 also has at least one contention window represented by the follower IO high drive signal 540. The follower IO high drive signal 540 also represents when a Follower device 102 is in alarm and tries to become a Master during a portion of the time $T_6$.

Referring back to FIG. 4, the time delay filter 424 is used to prevent unintended alarm actuation of Slave and/or Follower devices 102 from a logic high asserted on the IO bus 118 for less than a desired time period, e.g., 320 milliseconds+/−three (3) percent, and that the time delay filter 424 will not operate, e.g., assert a received logic high signal at input B of the processor 112 for an input from the IO bus 108 of less than a certain verification time period, e.g., about 300 milliseconds or less.

In combination with the B and C inputs to the processor 112 both being at a logic high, see Slave/Follower B*C signal 538, the Slave/Follower audible alert tone pulses 322 begin issuing therefrom after another time period $T_3$ has elapsed. Circuits within the Slave/Follower devices 102 are designed such that $T_1=T_2+T_3$, thereby synchronizing the Slave/Follower audible alert tone pulses 322 with the Master audible alert tone pulses 320. All synchronizations of the Slave/Follower devices 102 with the Master device 102 may be based upon the rising edges of the logic levels on the IO bus 118. Since $T_1$ is defined as being equal to the sum of $T_2$ and $T_3$, even though the time delay filter introduces a delay time, e.g., time period $T_2$, the audible alert tone pulses 320 and 322 will be synchronized and acoustically coherent.

For example, when there are two or more devices 102 going into a local hazard alarm condition and thereafter try to drive the IO bus 118 concurrently, three possible actions may occur. 1) A Master is in local alarm and drive the IO bus 118 to a logic high, 2) a Follower is in local alarm but does not drive the IO bus 118 to a logic high, rather it synchronizes to the positive edges of the signal 518 on the IO bus 118, and 3) a Slave in remote alarm synchronizes to the positive edges of the signal 518 on the IO bus 118. All audible alert tone pulses 320 and 322 are thereby synchronized and acoustically coherent.

Now there are three possible responses to contention issues between devices: 1) A device is in remote alarm before going into local alarm, this device will now become a Follower instead of a Slave. 2) If the IO bus 118 is in a logic high state during a contention window, then the Master device 102 goes from the Master state to a Follower state. And 3) if the device is in the follower state and the IO bus 118 is low for longer than a certain time period, e.g., seven (7) seconds then the Follower becomes the Master of the IO bus 118.

Figure 6:
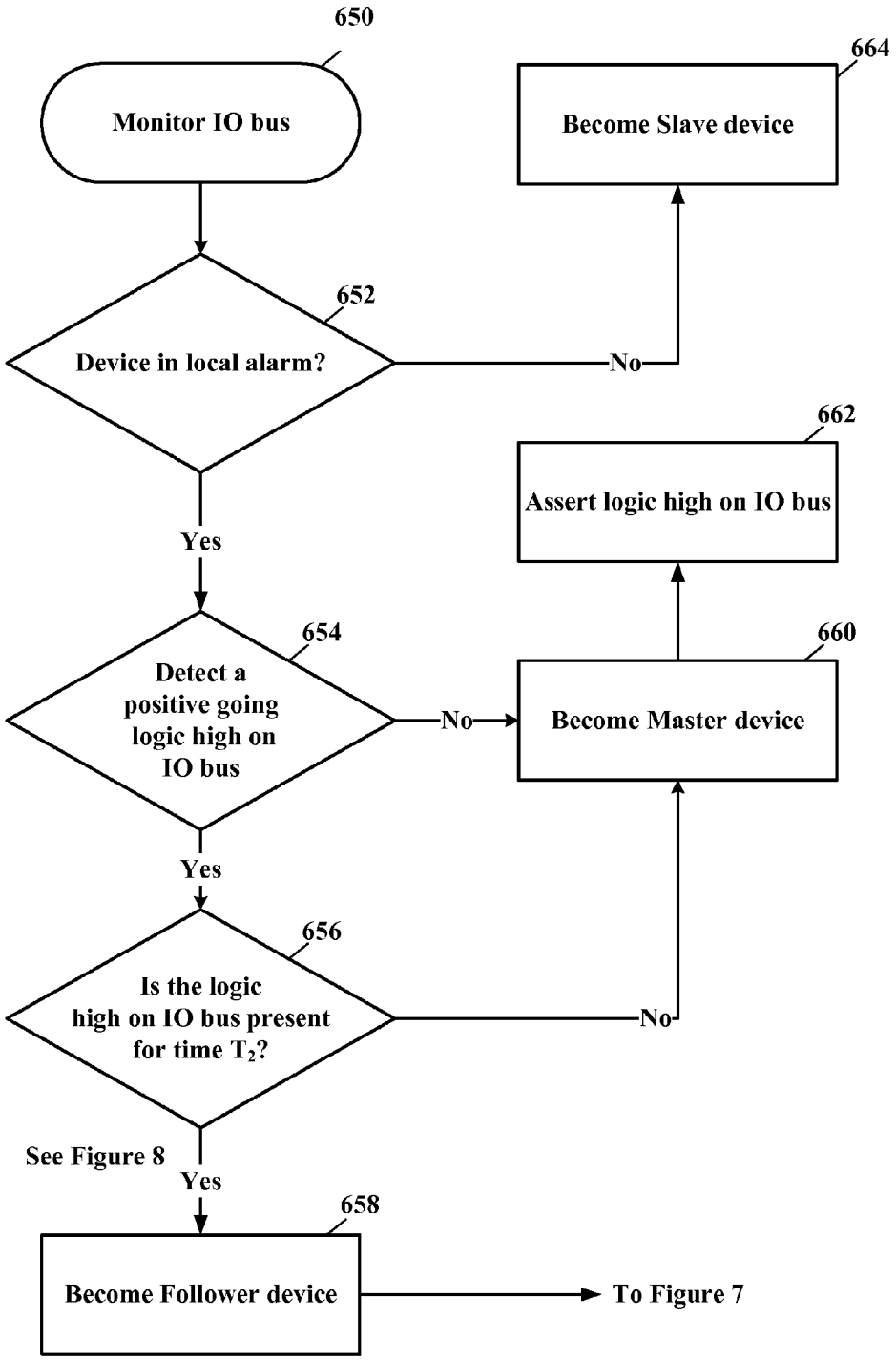
FIG. 6 illustrates a schematic process flow diagram determining Master/Follower/Slave status for each of the hazard detection and alarm signaling devices shown in FIG. 1, according to a specific example embodiment of this disclosure.

Referring to FIG. 6, depicted is a schematic process flow diagram determining Master/Follower/Slave status for each of the hazard detection and alarm signaling devices shown in FIG. 1, according to a specific example embodiment of this disclosure. In step 650 the IO bus 118 is monitored by each of the devices 102. Step 652 determines whether a device 102 is in a local alarm. If not in a local alarm, then in step 664 the device 102 becomes/remains a Slave device. If the device is in a local alarm, then step 654 determines if a positive going logic level, e.g., logic low to logic high, is detected on the IO bus 118 (output of bus receiver 116). If the positive going logic level is detected in step 654, then step 656 determines whether the logic high remains asserted on the IO bus 118 for a time $T_2$ (output of time delay filter 424). If the logic high does not remain asserted on the IO bus 118 for the time $T_2$, then in step 660 the device 102 becomes an IO bus Master, and in step 662 the new IO bus Master asserts a logic high onto the IO bus 118. However, if a logic high on the IO bus 118 does remain for time $T_2$, then in step 658 the device 102 becomes a Follower device.

Figure 7:
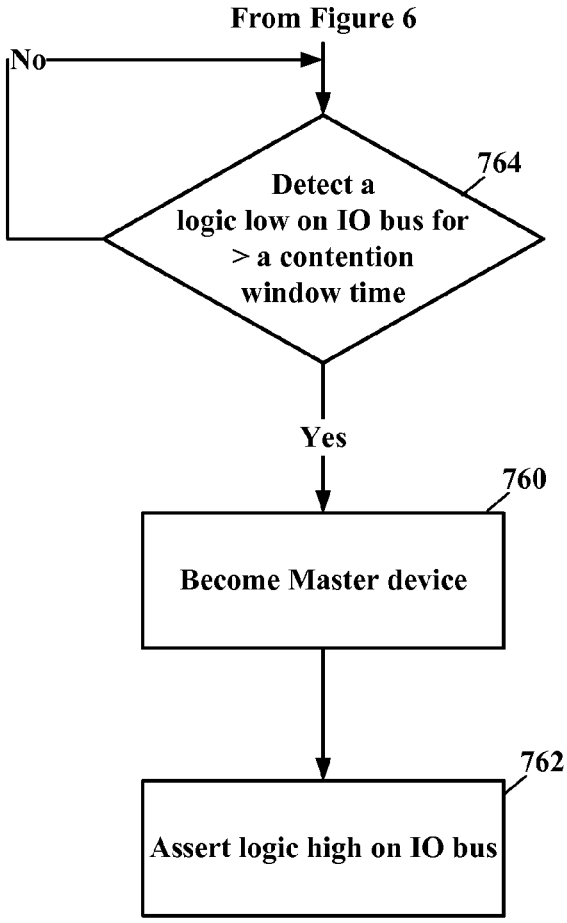
FIG. 7 illustrates a schematic process flow diagram showing conversion of a device from Follower to Master status, according to a specific example embodiment of this disclosure.

Referring to FIG. 7, depicted is a schematic process flow diagram showing conversion of a device from Follower to Master status, according to a specific example embodiment of this disclosure. The first device 102 to enter local alarm becomes the Master device. If any other device 102 enters local alarm from a remote alarm, it will become a Follower device 102 so as to avoid bus contention of having two devices 102 drive the IO bus 118 at the same time. When a device 102 is a Follower, i.e., in a local alarm but not asserting a logic high on the IO bus 108, step 764 determines whether during a contention time window there is not a logic high present on the IO bus 108 for a contention window time. The lack of a logic high on the IO bus 108 during the contention window time would indicate that the present Master device 102 is no longer in a local alarm condition. Therefore, the Follower device 102 that is still in a local alarm condition will now become a Master device 102 and take over assertion of a logic high on the IO bus 108 as more fully described hereinabove. When this situation occurs, in step 760 a previous Follower device 102 will become the Master device 102, and in step 762 the new Master device 102 will then assert a logic high on the IO bus 108 at the appropriate times for synchronizing the audible alert tone pulses 322 from the other Follower and Slave devices 102, as more fully described hereinabove.

Figure 8:
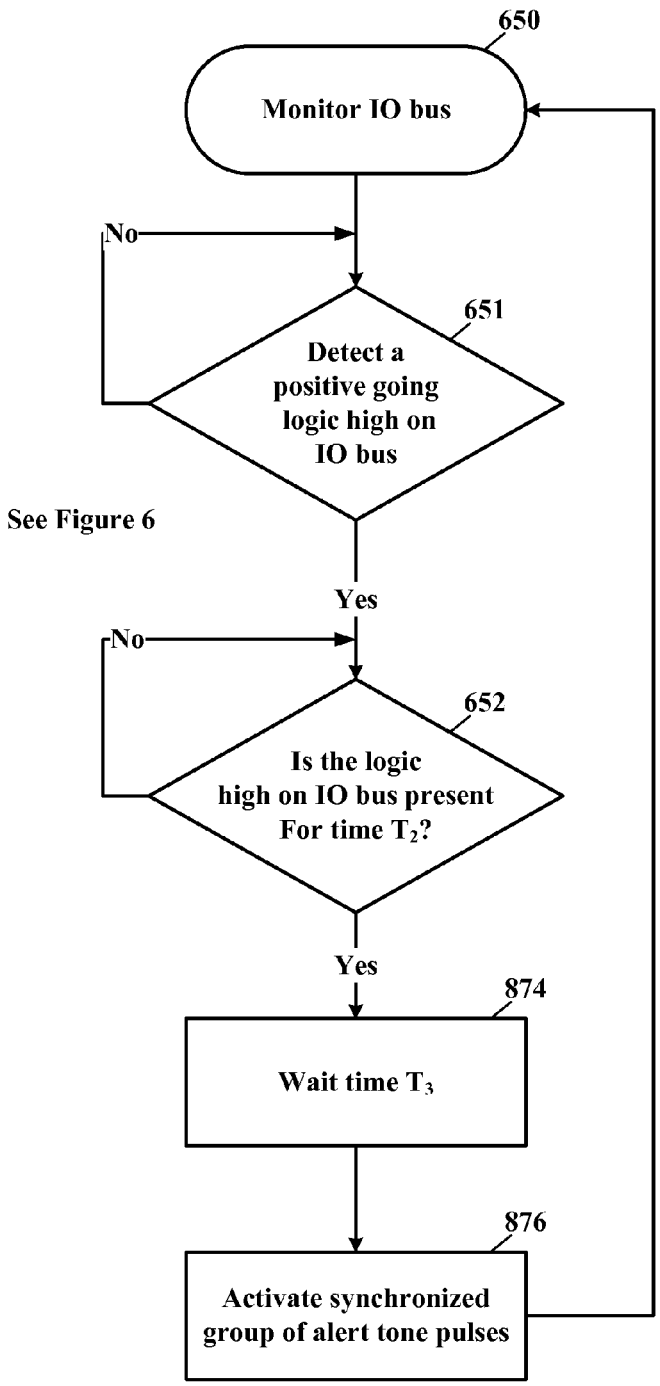
FIG. 8 illustrates a schematic process flow diagram for synchronizing alert tones from the Follower and Slave devices to the alert tones from the Master device, according to a specific example embodiment of this disclosure.

Referring to FIG. 8, depicted is a schematic process flow diagram for synchronizing alert tones from the Follower and Slave devices to the alert tones from the Master device, according to a specific example embodiment of this disclosure. The status of each of the devices 102 is determined, i.e., which one of the devices 102 is the Master, and the other devices 102 are Followers and Slaves depending on whether they are also in local alarm or not, respectively. However, any time a Master detects a high during its contention window (that is the time it is not driving the IO bus 118 high or low) the Master yields to the other device 102 driving the IO bus 118 and assumes Follower status. Finally, if a Follower senses no activity on the IO bus 118 for a certain length of time, e.g., seven (7) seconds, then the Follower will become the Master. This prevents Followers from getting into a state where they continue alarming alone in an interconnected system.

Steps 650, 651 and 652 from FIG. 6 are shown again for clarity. When the criteria in steps 651 and 652 are satisfied, the logic in each device will wait a time $T_3$ before starting a three alert tone sequence in step 876. The Master device waits a time T1 after asserting a logic high on the IO bus 118 before starting the sequence of three audible alert tone pulses 320 shown in FIG. 5. Since T1=T2+T3 (see FIG. 5) the audible alert tone pulses 320 and 322 are substantially in synchronization and acoustically coherent.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure.

What is claimed is:

1. A method for temporal horn pattern synchronization, comprising the steps of:

monitoring an input-output bus coupling together a spatially diverse plurality of hazard detection and alarm devices;

detecting when the input-output bus at a first logic level goes to a second logic level;

determining if the second logic level remains on the input-output bus for a first time period, wherein if so, then determining which ones of the plurality of hazard detection and alarm devices are in a local alarm condition and which other ones are not in the local alarm condition, wherein the ones that are in the local alarm condition are designated as follower devices and the other ones that are not in the local alarm condition are designated as slave devices, and if not, then determining when one of the plurality of hazard detection and alarm devices is in the local alarm condition;

making a first one of the plurality of hazard detection and alarm devices in the local alarm condition a master device;

asserting the second logic level on the input-output bus with the master device;

asserting the first logic level on the input-output bus with the master device for short times between asserting the second logic level thereon; and synchronizing groups of alert tone pulses from the master, follower and slave devices.

2. The method according to claim 1, further comprising the steps of:

waiting a second time period after determining that the second logic level has remained on the input-output bus for the first time period; and activating a synchronized group of alert tone pulses from the follower and slave devices.

3. The method according to claim 2, further comprising the steps of:

waiting a third time period after asserting the second logic level on the input-output bus with the master device; and activating a synchronized group of alert tone pulses from the master device, wherein the third time period is equal to the sum of the first and second time periods.

4. The method according to claim 1, further comprising the steps of:

determining whether the input-output bus remains at the first logic level for a certain time during a contention time window, wherein if so, then making a one of the follower devices a new master device and having the new master device assert the second logic level on the input-output bus; and if not, then retaining prior status for each of the master, follower and slave devices.

5. The method according to claim 1, wherein the first logic level is a low logic level and the second logic level is a high logic level.

6. The method according to claim 1, wherein the first logic level is a high logic level and the second logic level is a low logic level.

7. The method according to claim 1, wherein the first and second logic levels are different voltage values on the input-output bus.

8. The method according to claim 1, wherein the first and second logic levels are different current values into the input-output bus.

9. The method according to claim 1, wherein each group of the alert tone pulses are three tone pulses within about four seconds.

10. The method according to claim 1, wherein the plurality of hazard detection and alarm devices are capable of detecting hazards selected from the group consisting of fire, smoke, carbon monoxide, radon, natural gas, chlorine, water and moisture.

11. A hazard detection and alarm system, said system comprising:

a plurality of hazard detection and alarm devices coupled together with an input-output bus, where the plurality of hazard detection and alarm devices are spatially diverse;

one of the plurality of hazard detection and alarm devices becomes a master when in a local alarm, other ones of the plurality of hazard detection and alarm devices become followers when in a local alarm occurring after the occurrence of the master local alarm, and still other ones of the plurality of hazard detection and alarm devices become slaves when not in a local alarm; and the master asserts a second logic level on the input-output bus that was previously at a first logic level, then periodically asserts the first logic level on the input-output bus for a first time period, then thereafter asserts no logic level on the input-output bus for a second time period and thereafter reasserts the second logic level on the input-output bus, wherein all followers and slaves synchronize their alert tone pulse groups to alert tone groups of the master from when the input-output bus goes from the first logic level to the second logic level and remains at the second logic level for a first time period.

12. The system according to claim 11, wherein when one of the followers in local alarm detects that the input-output bus is at the first logic level for a certain time, that follower becomes the master and thereafter asserts the second logic level on the input-output bus.

13. The system according to claim 11, further comprising the master asserting no logic level between the assertion of the first logic level and second logic level, wherein if the master detects that the input-output bus is at the second logic level when not asserting the first or the second logic levels on the input-output bus, the master becomes a follower.

14. The system according to claim 11, wherein the plurality of hazard detection and alarm devices have at least one sensor capable of detecting at least one hazard selected from any one or more of the group consisting of fire, smoke, carbon monoxide, radon, natural gas, chlorine, water and moisture.

15. The system according to claim 11, wherein each of the plurality of hazard detection and alarm devices comprises:

a hazard detector;

an alarm alert generator;

an audible sound reproducer coupled to an output of the alarm alert generator;

a digital processor having a first input coupled to the hazard detector for receiving a hazard detection signal and a first output coupled to the alarm alert generator for control thereof;

a bus driver having an input coupled to a second output of the digital processor and an output coupled to the input-output bus;

a bus receiver having an input coupled to the input-output bus and an output coupled to a second input of the digital processor; and a time delay filter having an input coupled to the output of the bus receiver and an output coupled to a third input of the digital processor.

16. The system according to claim 15, wherein the digital processor determines a master, follower or slave state of the hazard detection and alarm device.

17. The system according to claim 15, wherein the digital processor is a microcontroller.

18. A hazard detection and alarm device comprises:

a hazard detector;

an alarm alert generator;

an audible sound reproducer coupled to an output of the alarm alert generator;

a digital processor having a first input coupled to the hazard detector for receiving a hazard detection signal and a first output coupled to the alarm alert generator for control thereof;

a bus driver having an input coupled to a second output of the digital processor and an output adapted for coupling to an input-output bus;

a bus receiver having an input adapted for coupling to the input-output bus and an output coupled to a second input of the digital processor; and a time delay filter having an input coupled to the output of the bus receiver and an output coupled to a third input of the digital processor;

wherein the digital processor determines a master, follower or slave state of the hazard detection and alarm device.

19. The hazard detection and alarm device according to claim 18, wherein the alarm alert generator comprises:

an audio tone generator;

an audio tone pulse synchronization circuit having an input coupled to the audio tone generator; and an audio power amplifier having an input coupled to an output from the audio tone pulse synchronization circuit and an output coupled to the audible sound reproducer.

20. The hazard detection and alarm device according to claim 18, wherein the bus driver has a low impedance first output state, a low impedance second output state, and a high impedance output state, wherein selection of the output states are controlled by the digital processor.

* * * * *